US006004114A

United States Patent [19]

Cunningham et al.

[11] Patent Number: 6,004,114

[45] Date of Patent: Dec. 21, 1999

[54] HYDRAULIC SUBMERSIBLE PUMP FOR OIL WELL PRODUCTION

[76] Inventors: Edmund C. Cunningham, 295 Arbour Lake Way N.W., Calgary, Alberta, Canada, T3G 3Z8; Gerald R. Leeb, Box 89, Strom, Alberta, Canada, T0B 2H0

[21] Appl. No.: 09/023,086

[22] Filed: Feb. 13, 1998

[51] Int. Cl.[6] ..... F04B 17/00

[52] U.S. Cl. ..... 417/375; 417/904; 166/105

[58] Field of Search ..... 418/48; 417/360, 417/375, 904; 166/105

[56] References Cited

U.S. PATENT DOCUMENTS

| | | | |
|---|---|---|---|
| 2,737,119 | 3/1956 | Hill | 418/48 |
| 3,833,060 | 9/1974 | Craggs et al. | 166/68 |
| 4,386,654 | 6/1983 | Becker | 166/105.5 |
| 5,209,294 | 5/1993 | Weber | 166/105 |
| 5,501,580 | 3/1996 | Barrus et al. | 417/410.3 |

FOREIGN PATENT DOCUMENTS 2209803 8/1997 Canada .

2209869 11/1997 Canada .

OTHER PUBLICATIONS

One page sheet titled "Proalta Rodless Lift System", 1996.

*Primary Examiner*—Charles G. Freay
*Attorney, Agent, or Firm*—Thomas E. Malyszko

[57] ABSTRACT

A flow control assembly is provided for a submersible pump drive which has a hydraulic drive motor and a bearing pack for sealing a drive shaft which transfers drive from the drive motor to an oil well pump. The flow control assembly incorporates a production containment device for engaging said bearing pack The production containment device has a collar for supporting the bearing pack, drive shaft and hydraulic drive motor within the submersible pump drive, and a passageway through the collar for channeling fluid therethrough. The flow control assembly further includes a seal protection device for demountably engaging the bearing pack opposite the hydraulic drive motor. The seal protection device has a fluid deflecting cone shaped tip and a hollow cylindrical portion adjacent the tip for receiving a lubricant to impede any fluid entering the seal protection device from migrating through the bearing pack.

15 Claims, 4 Drawing Sheets

HYDRAULIC SUBMERSIBLE PUMP FOR OIL WELL PRODUCTION

FIELD OF THE INVENTION

The present invention relates to a submersible pump arrangement, and in particular to a flow control assembly for a hydraulic submersible pump arrangement for use in oil well production.

BACKGROUND OF THE INVENTION

The tight confines of oil well casings limit the space in which to run production tubing strings having submersible pump arrangements at their bottom ends for pumping oil and other fluids through great depths to the surface. In a production casing of 5.5 inches (aprox. 139.7 mm) diameter, the available space for a pump arrangement is about 4.85 inches (123.2 mm). Small electric submersible or subsurface pump drives have been used with progressive cavity pumps for these purposes. Subsurface drives are particularly suited for use in deviated and horizontal wells since they do not employ a turning drive shaft which extends from the well's surface; and, progressive cavity pumps are preferred since they can pump liquids containing sand and other particular matter which is often mixed with production fluids. Although the electric submersible pumps fit within the tight confines of a well casing, they suffer from several drawbacks in oil well applications: they are not good for pumping fluids mixed with solids; they require a permanent electrical service; they are expensive to install; and they frequently suffer from pinched power lines since electric cable is attached to the exterior of the production tubing.

It would be preferable to replace the electric submersible pumps with much less expensive hydraulic submersible pump drives or motors which are typically used in other oil field applications, such as current surface drives, mobile tank trucks, service rigs, and hydraulic reciprocating pumping units. Such drive motors are attractive since fewer specialty components are required for installation and operation. However, these motors are fairly bulky and tend to restrict production fluid flow through a pump arrangement. In particular, a problem exists with the mounting assemblies which must be employed about the drive motors for centralizing and supporting the drive motors within the pump assemblies. Unfortunately, the area about the drive motors forms a "bottle neck" for the produced fluids since the flow area is the most constricted in this location. Therefore, the mounting assemblies exacerbate the problem by further restricting the already limited fluid flow area. Even the physically smaller electric drives are mounted below progressive cavity pumps to avoid undue restriction and fluid flow past the electric motor in the production tubing above the pump.

Another problem with current pump drives , both electric and hydraulic ones, is that the production fluid flowing to or past the drive assembly pump directly impacts the upstream bearing pack which houses the pump's drive shaft. Such fluid impact (and the suspended particulate matter) deteriorates the bearing pack seals and causes leaks into the bearings over a relatively short operational time span. For conventional surface drives such seals can be readily serviced to avoid surface oil spills. In subsurface drives, however, the drive pump equipment cannot be serviced until a failure occurs and must be retrieved for servicing and replacement. Therefore protecting and extending the operating life of these seals will prevent frequent and costly servicing.

What is therefore desired is a novel submersible pump arrangement for use with oil well production tubing which overcomes the limitations and disadvantages of the existing arrangements. Preferably, it should allow the use of hydraulic drive motors in such pump arrangements for pumping production fluids. In particular, it should provide a flow control assembly for supporting a hydraulic drive motor within the pump arrangement without restricting the fluid flow area about the drive motor body. The flow control assembly should further reduce the impact of fluid flow on the bearing pack of the drive motor to increase the operational life of its seals and bearings, and thus reduce servicing costs.

SUMMARY OF THE PRESENT INVENTION

In one aspect the invention provides a flow control assembly for a submersible pump drive having a hydraulic drive motor and a bearing pack adjacent thereto for sealing a drive shaft which transfers drive from the drive motor, the flow control assembly comprising:

a production containment device for engaging said bearing pack having:

a collar for supporting said bearing pack, drive shaft and hydraulic drive motor within said submersible pump drive; and, a passageway through said collar for channeling fluid therethrough.

In another aspect the flow control assembly further includes a seal protection device for demountably engaging said bearing pack opposite said hydraulic drive motor, said seal protection device having a fluid deflecting cone shaped tip.

In a further aspect the invention provides a pump drive arrangement for an oil well having production tubing extending through a well bore, said pump drive arrangement comprising:

a subsurface rotary pump movably located in the well bore for pumping fluid through the well bore;

a hydraulic drive motor having first and second opposed ends, said first end being located adjacent the subsurface rotary pump and operatively connected thereto to drive said subsurface rotary pump;

BRIEF DESCRIPTION OF THE DRAWING FIGURES

Embodiments of the invention will now be described, by way of example only, with reference to the accompanying drawings, wherein:

FIG. 1 is a schematic view partially in vertical cross-section showing an above-ground wellhead area, a production tubing string extending from the wellhead area down an oil well to a horizontal portion thereof, and a hydraulic submersible pump arrangement connected at its top end to the production tubing string and at its bottom end to a progressive cavity pump for use in production of the oil well;

LIST OF REFERENCE NUMERALS IN DRAWINGS

| | |
|---|---|
| 10 | hydraulic submersible pump arrangement |
| 11 | production tubing |
| 12 | connections of 11 |
| 13 | wellhead |
| 14 | hydraulic tubing (supply) |
| 15 | hydraulic tubing (return) |
| 16 | hydraulic pump at surface |
| 20 | progressive cavity pump |
| 21 | stator of 20 |
| 22 | rotor of 20 |
| 30 | hydraulic drive motor |
| 31 | body of 30 |
| 31a | alternate embodiment of 31 |
| 31b | flow passage past 31a |
| 32 | end port manifold of 30 |
| 33 | hydraulic line (supply) of 30 |
| 34 | hydraulic line (return) of 30 |
| 35 | housing of 30 |
| 36 | drive shaft of 30 |
| 40 | bearing pack |
| 41 | body of 40 |
| 42 | shaft of 40 |
| 43 | tapered roller bearing (top) of 40 |
| 44 | bottom roller bearings of 40 |
| 45 | top mechanical seal of 40 |
| 46 | bottom rotary shaft seal of 40 |
| 50 | flow control assembly |
| 51 | production containment collar of 50 |
| 52 | outer collar of 51 |
| 53 | inner collar of 51 |
| 54 | passageway of 51 |
| 55 | centralizers of 51 |
| 56 | inside threaded surface of 53 |
| 57 | exterior threaded surface of 52 |
| 58 | interior threaded surface of 52 |
| 59 | o-ring seal groove of 57 |
| 60 | seal protection cone |
| 61 | conical bottom end of 60 |
| 62 | hollow cylindrical portion of 60 |
| 63 | internal surface of 62 |
| 63a | threads on 63 |
| 64 | barrier seal in 62 |
| 70 | production fluid connector sub |
| 80 | main drive shaft |
| 81 | balancer on 80 |
| 90 | production containment jacket |
| 91 | centralizers of 90 |
| 92 | body of 90 |
| 93 | internal thread of 90 |

DESCRIPTION OF PREFERRED EMBODIMENT

Figure 1:
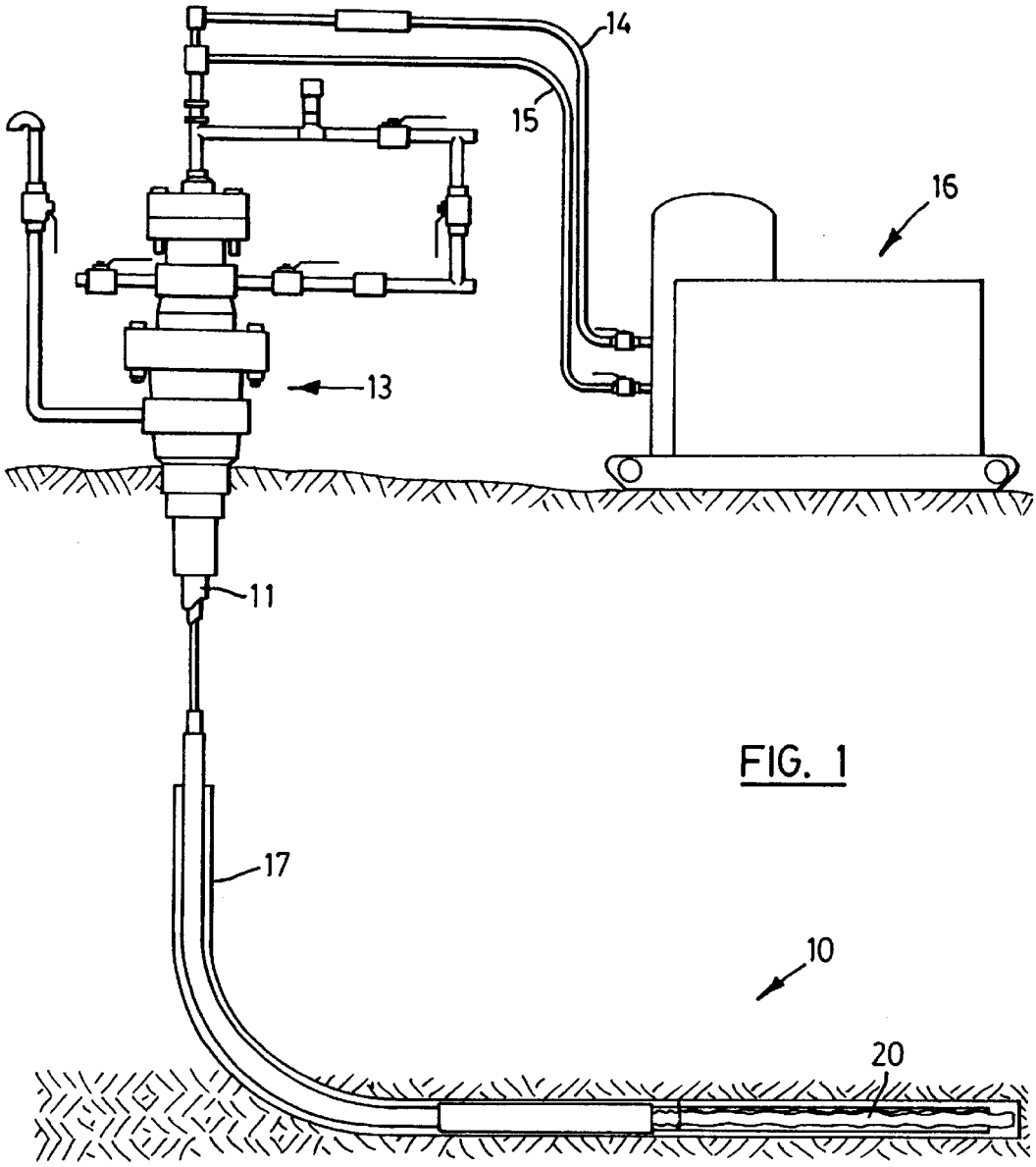
Figure 2:
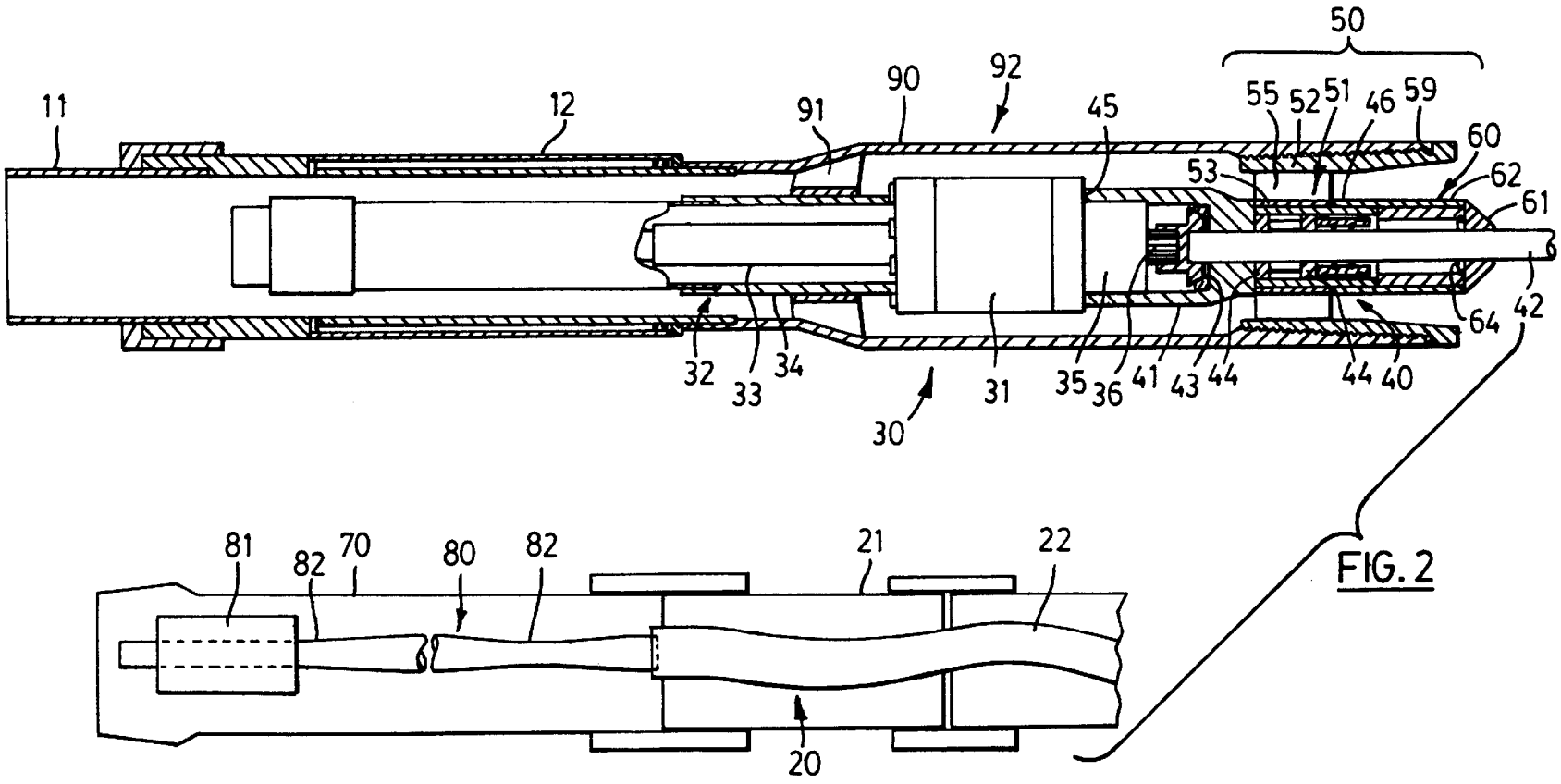
FIG. 2 is a cross-sectional side view of the hydraulic submersible pump arrangement of FIG. 1 showing a flow control assembly according to a preferred embodiment of the present invention.
Figure 2A:
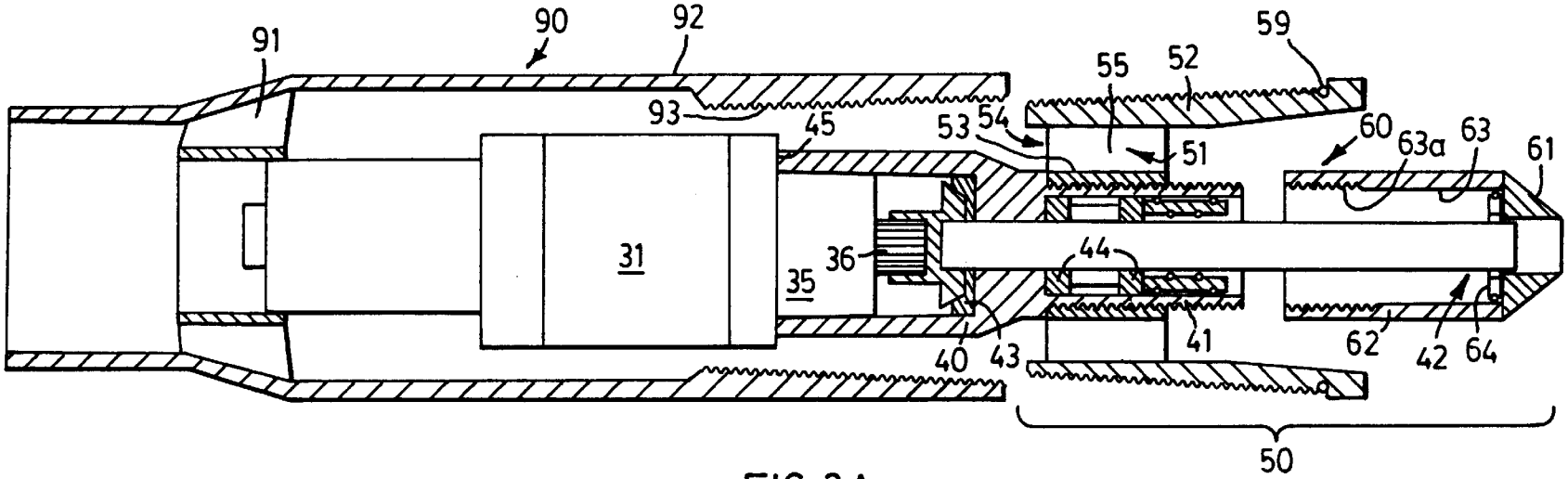
FIG. 2A is a close-up view of the flow control assembly of FIG. 2 showing the hydraulic submersible pump arrangement partially decoupled.

FIGS. 1, 2 and 2A show a hydraulic submersible pump arrangement or pump drive (generally designated by reference numeral 10) within a production casing 17 lining a well bore. The pump drive is typically connected to a production tubing string 11, be it endless coiled tubing or conventional joined pipe sections, via production tubing connections 12 at the pump drive's top end (i.e. closest to the wellhead 13 at ground level, and shown to the left of the pump drive in FIGS. 1 & 2), and to a progressive cavity pump at its bottom end (shown to the right of the pump drive in FIGS. 1 & 2). The pump drive 10 is an arrangement of the following general components: a hydraulic drive motor 30 for providing rotation or torque to the progressive cavity pump 20; a sealed bearing pack 40 for the drive motor 30; a flow control assembly 50 which includes a production containment collar 51 and a seal protection cone 60; a production fluid connector sub 70 which connects to the collar 51; a main drive shaft 80 for transferring torque from the bearing pack 40 to the progressive cavity pump 20; and, a production containment jacket 90 which houses the entire pump drive and contains the produced fluid for flow past the pump drive to the production tubing string 11. The pump drive described herein using the hydraulic drive motor is particularly suited for deviated, directional or horizontal wells, or in any applications which use a subsurface rotary pump, particularly for heavy oil.

A more important part of the present arrangement 10 is the flow control assembly 50, although it is advantageous to first describe some of the other components noted above in order to better understand the flow control assembly.

Referring first to the hydraulic drive motor 30, a hydraulically driven down-hole motor is employed which has been modified for use in the present arrangement. A prior art mounting for supporting the drive motor's body 31 inside the production containment jacket has been removed to eliminate unnecessary interference with production fluid flow, and has been replaced by the production containment collar 51 of the present invention, as discussed below. Prior to the present invention, use of hydraulically driven motors in the tight confines of production tubing strings has been limited and largely impractical as a result of undue restrictions in fluid flow about the motor past its prior art mountings. An end port manifold 32 at the motor's top end has also been modified to accept concentric hydraulic lines 33 and 34 which supply and return, respectively, hydraulic fluid to operate the motor. The supply line 33 is typically about 1 inch (2.5 cm) in diameter and the return line 34 is about 1.5 inch (3.8 cm) in diameter. The hydraulic lines 33, 34 may be either endless tubing or conventional tubing, and communicate with respective surface hydraulic supply and return tubing 14 and 15, respectively, connected to a hydraulic pump 16 for running the hydraulic system at a desired pressure and volume. Typically this can be achieved with a pump capable of 30 gal/min. (aprox. 114 liters/min.) flow at a maximum pressure of 3000 psi (aprox. 21 MPa). A housing 35 extends from the motor's bottom end and houses a motor drive shaft 36 which in the preferred embodiment is a stock 1.25 inch (3.18 cm) diameter shaft with a 14 tooth splined end. The motor drive shaft housing 35 has had the stock flanged bolt mounting removed, and the exterior of the housing has been threaded with 6 stub left hand threads for accepting a portion of the bearing pack 40, as noted below. An o-ring seal face is also machined into the housing upset that connects to the motor body 31.

Figure 5:
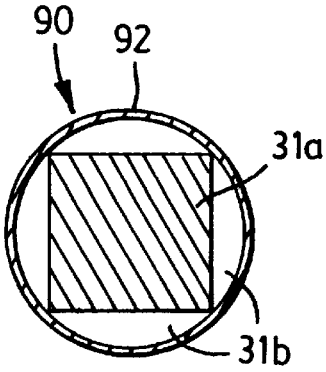
FIG. 5 is a cross sectional view along line 5—5 of FIG. 2 showing another embodiment of a drive motor of the hydraulic submersible pump arrangement.

In the FIG. 2 embodiment the drive motor's body or housing 31 is generally circular in cross-section to provide a generally uniform passage for fluid between the body 31 and the jacket 90. In an alternate embodiment shown in FIG. 5, a generally square shaped drive motor housing 31*a* is used. The edges of the motor housing 31*a* engage the jacket's generally circular body 92 to center the motor within the jacket, to allow production fluid to flow past the motor through passages 31*b*, and to provide support and reduce side loadings on the motor during use. The motor housing can be sized to fit most jackets or casings. In certain applications the motor 31*a* may be used directly within a casing without a containment jacket, which simplifies assembly and provides a sturdier motor assembly. It will be appreciated that other motor housing shapes may also be suitable, such as triangular, rectangular, hexagonal, and the like.

Below the hydraulic drive motor 30 is the self lubricated, pressure compensating and sealed bearing pack 40. The bearing pack isolates the hydraulic drive motor from lateral loading from the drive shaft and hydrostatic loading of the production fluid, and its seals prevent hydrostatic pressure from acting on the seals and bearings of the hydraulic drive motor. The bearing pack 40 has four primary components. First, a bearing pack body 41, whose outer diameter can vary depending on specific applications, contains bearing seats and left hand thread connections at its top and bottom ends for screwing onto the threaded drive motor housing 35 and the production fluid connector sub 70 via the production containment collar 51, respectively. Second, a bearing pack shaft 42 of about 1 inch (2.5 cm) outer diameter or greater, has at its top end a 1.25 inch 14 tooth female spline connection for engaging the male splined end of the motor drive shaft 36 when the bearing pack body 41 is screwed onto the hydraulic motor housing 35 (as shown in FIG. 2). The bottom end of the shaft 42 is threaded to connect to the main drive shaft 80.

Third, the bearing pack has a series of bearings for carrying anticipated loadings on the shaft 42 to production depths of up to 3000 m (9900 feet). A tapered roller bearing 43 adjacent the shaft's top splined end is provided to carry all of the hydrostatic loadings, whereas the bottom of the shaft 42 is stabilized by two bottom roller bearings 44. Fourth, the bearing pack includes two sets of seals. A top mechanical seal 45 is placed between the machined seal face of the drive motor housing 35 and the bearing pack body 41, and is squeezed when the threaded connection between them is made up. A bottom double rotary shaft seal 46 is built into a seal cartridge having a number of outside o-ring seals and inside rotary seals. The cartridge slides over the bearing pack shaft 42 into a cavity at the bottom of the bearing pack body 41, and is retained in the cavity by two snap rings in the bearing pack body 41. The seal cartridge is made shorter than the cavity to allow internal bearing pack pressure to equalize with hydrostatic or external pressure (i.e. that of the production fluid) if internal pressure happens to exceed the hydrostatic or external pressure.

The production fluid connector sub 70 located below the bearing pack is a heavy, hollow, tubular component with left hand threads at each end. The top end of the sub connects to the production containment collar 51, as discussed below, and the bottom end of the sub connects to the stator 21 of the progressive cavity pump 20 with a left hand threaded connection. The left hand connections between the drive motor housing 35 and the pump stator 21 counter act or dampen the opposite or right hand torque forces produced when operating the drive motor 30, thus allowing the overall arrangement 10 to operate without significant residual torque forces above the motor housing or below the pump stator.

The main drive shaft 80 transfers rotation or torque from its top threaded connection with the bearing pack shaft 42 to its bottom threaded connection with the rotor 22 of the progressive cavity pump 20. For contemplated applications the main drive shaft is typically about 1.25 inches (aprox. 3.2 cm) in diameter and about 4 to 8 feet (1.2 m to 2.4 m) in length, is preferably stainless steel to allow greater flexure with less fatigue than other metals, incorporates 1×6 inch radiused notches 82 (of 0.25 inch radius) at its top and bottom ends, and carries an automatic balancer 81 if necessary near the shafts connection with the bearing pack 40. The main drive shaft dampens or negates the effects of the eccentric turning of the pump rotor 22, and the balancer 81 is adapted to counterbalance any remaining or residual vibrations prior to their reaching the bearing pack.

The production containment jacket 90 has a main body 92 which extends the full length of the hydraulic drive motor 30 for housing the motor, and contains and directs the produced fluid past the drive motor to the production tubing string 11 to which the jacket connects. The jacket incorporates centralizers 91 which slide over the concentric end port manifold 32 for supporting the hydraulic lines 33, 34. The bottom of the jacket's main body 92 is threaded on an inside surface at 93 for connection to the production containment collar 51, and is also threaded at its inside top end for engaging with the connection 12 of the tubing string.

Figure 3:
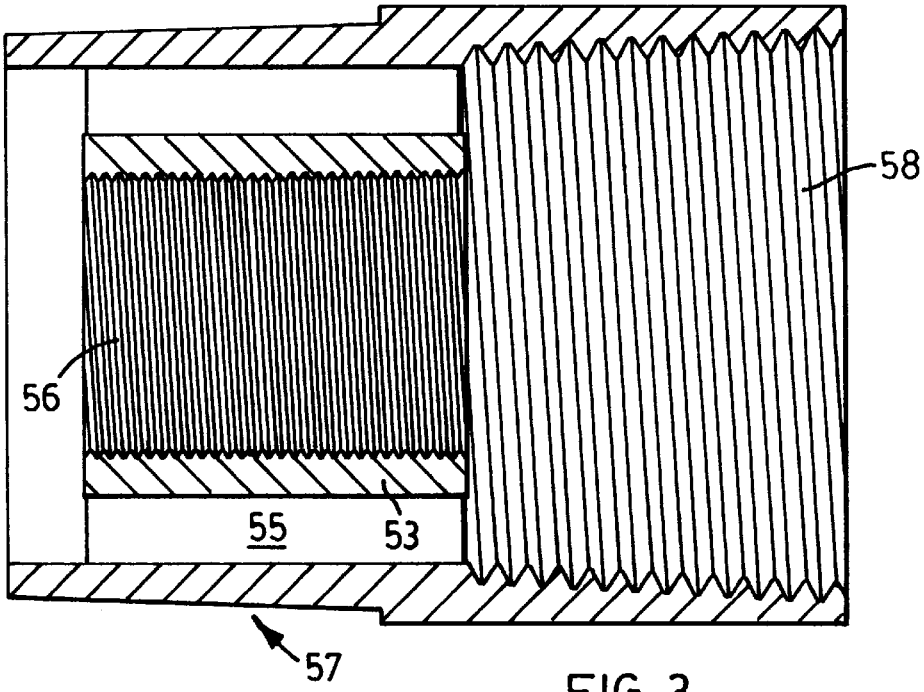
FIG. 3 is a close-up cross-sectional view of a flow control collar of the flow control assembly of FIG. 2.
Figure 4:
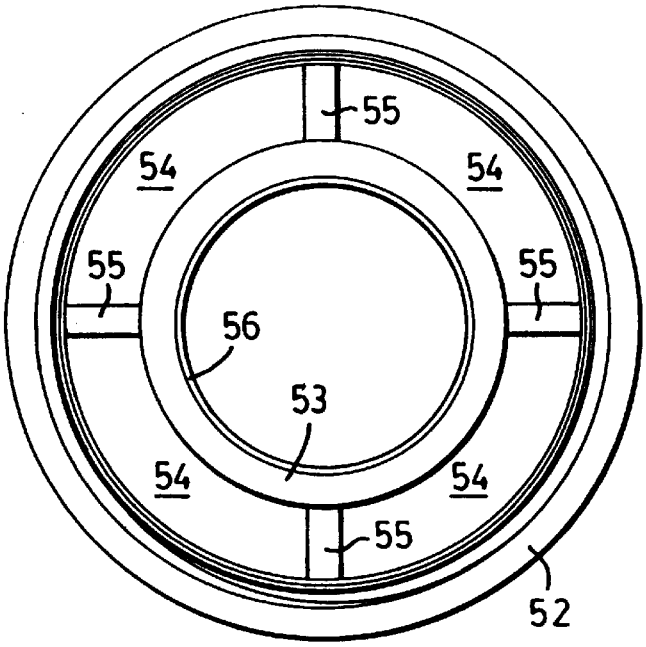
FIG. 4 is an end view of the flow control collar of FIG. 3.

One of the more important aspects of the present invention is now addressed with reference to FIGS. 3 and 4 in particular which show in greater detail the production containment or flow control collar 51 of the flow control assembly 50. The collar 51 has an outer collar or tubing 52 (the bottom end of which is partially truncated in the FIGS. 2 and 2A views) which surrounds a concentric inner collar 53 spaced therefrom to form a void or passageway 54 for accommodating flow of production fluid through the collar 51. Four circumferentially spaced centralizer bars 55 position the inner collar 53 within the outer collar 52. It is understood that the number of centralizer bars and their circumferential spacing may be varied as desired. The inner collar 53 has an inside left hand (6 acme) threaded surface 56 for connection onto the bearing pack body 41 via a left hand thread connection. The top of the outer collar 52 has an external threaded surface 57 for screwing into the inner threaded bottom end of the production containment jacket 90, and a groove 59 (shown in FIG. 2A) for accepting an o-ring seal to seal the connection. The bottom of the outer collar 52 has an internal threaded surface 58 for making a left hand threaded connection onto a threaded outside surface at the top of the connector sub 70. When fully engaged, the production containment collar 51 therefore positions (i.e. centralizes) and supports the bearing pack 40 and, indirectly, the hydraulic drive motor body 31 within the production containment jacket 90 via the centralizers 55, and provides a substantially unobstructed passageway 54 for produced fluid flow over the bearing pack 40. An important feature of the present invention is that the collar 51 is able to support the motor body 31 within the jacket 90, yet be located away from the motor body to leave an unobstructed flow area between the motor body and the jacket 90. Such larger clear space in this "bottle necked" portion of the produced fluid flow path through the pump arrangement 10 therefore alleviates some of the problems and restrictions of prior art pump arrangements.

Referring again to FIGS. 2 and 2A, another important aspect of the flow control assembly 50 is the seal protection mechanism or cone 60 located within the collar 51. The cone 60 has a conical bottom end 61 with a central opening to fit over the main drive shaft 80, and functions to deflect produced fluid flow away from the bearing pack shaft 42 area and around the bearing pack body 41. Adjacent the conical bottom end is a hollow cylindrical portion 62 with an internal surface 63 threaded with left hand threads 63*a* at its top end for screwing onto the bottom end of the bearing pack body 41 just behind the inner collar 53 of the production containment collar. The cylindrical portion 62 butts up against the edge of the bearing pack body which forms the cavity that holds the rotary shaft seal 46. The hollow cylindrical portion 62 contains a heavy lubricant or grease buffer compound and a barrier seal 64 adjacent the conical end which is forced slowly upwardly (i.e. to the left in FIG. 2) should pressurized production fluid seep through the conical bottom 61 of the cone, thus forcing fresh lubricant into the bearing pack to delay or prevent contaminants from reaching the seals within the bearing pack, and thereby lengthening the seals' operational lives.

In setting up the flow control assembly onto the pump drive for operation, the inner collar 53 is threaded onto the bearing pack body 41 so that at fill make up the threaded bearing pack body protrudes out of the bottom end of the inner collar as shown. This centres the drive motor 30 and the bearing pack within the casing and transfers torque containment to the connector sub 70. The seal protection cone 60 is then slid over the drive shaft 42 and is screwed onto the protruding threads of the bearing pack body until it makes up (i.e. engages) against the bottom end of the inner flow control collar 53. The production containment jacket 90 is then slid over the top of the drive motor and is made up with the external threaded surface 57 of the containment collar. The main drive shaft 80 is next connected to the bearing pack drive shaft 42 and to the progressive cavity pump rotor 22. The connector sub 70 is next threaded into the internal threaded surface 58 of the collar 51 to complete the connection between the drive motor and the connector sub. The bottom of the connector sub is then threaded via left hand thread to the pump stator 21.

Some of the many advantages of the hydraulic submersible pump arrangement, and in particular the flow control assembly of the present invention, may now be better appreciated. First, the collar 51 centers and supports the drive motor 30 and the bearing pack 40 within the production containment jacket to prevent bending and twisting of these components during use which could reduce the serviceable life of these components and cause damage to or failure of the production system. Second, by altering the bearing pack configuration to locate the collar 51 and its centralizers 55 away from the most constricted area of the production fluid path, namely about the hydraulic drive motor body 31, production fluid flow capacity is increased, thus reducing or eliminating a restricting factor which until now has hindered or prevented effective use of hydraulic drive motors within production tubing. Third, the cone 60 increases the life of the bearing pack, and consequently reduces servicing and equipment replacement costs, by delaying or preventing production fluid from contacting the bearing pack's seals and bearings. The conical bottom end 61 deflects the production fluid from the bearing pack, thus preventing direct impact by the flowing fluid with the bearing pack seals which in prior art arrangements caused relatively rapid deterioration and failure of the seals. Even in the event of fluid penetration through the conical end 61 into the cone 60, progress of the fluid toward the bearing pack interior is delayed or prevented by the barrier seal 64 and the packed lubricant behind the seal.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, the number of collar centralizers 55 may be decreased or increased in other embodiments, although the latter may not be preferred if fluid flow is unduly restricted. Also, it will be appreciated that the pump arrangement of the present invention may be employed for well bore injection operations by reversing rotation of the drive motor.

We claim:

1. A flow control assembly for a submersible pump drive having a hydraulic drive motor and a bearing pack adjacent thereto for sealing a drive shaft which transfers drive from the hydraulic drive motor, the flow control assembly comprising:

a production containment device for engaging said bearing pack having:

a collar for supporting said bearing pack, drive shaft and hydraulic drive motor within said submersible pump drive; and, a passageway through said collar for channeling fluid therethrough.

2. The flow control assembly of claim 1 wherein said collar comprises an inner collar portion for demountably engaging said bearing pack, an outer collar portion radially spaced from said inner collar portion to form said passageway therebetween, and a means for securing said outer collar portion relative to said inner collar portion.

3. The flow control assembly of claim 2 wherein said means for securing comprises at least two spaced centralizer plates spanning said passageway and fixed to said inner and outer collar portions.

4. The flow control assembly of claim 3 wherein:

said inner collar portion comprises an elongate hollow cylindrical member having a threaded inside surface for screwing onto said bearing pack, and a generally smooth outside surface adjacent said passageway and fixed to said at least two centralizer plates; and, said outer collar portion comprises an elongate hollow cylindrical member having interior surface adjacent said passageway a portion of which is fixed to said at least two centralizer plates and another portion of which has a threaded connection means, and an exterior surface a portion of which is threaded for engaging a part of said submersible pump drive which extends about said hydraulic drive motor.

5. The flow control assembly of claim 1 further comprising a seal protection device for demountably engaging said bearing pack opposite said hydraulic drive motor, said seal protection device having a fluid deflecting cone shaped tip.

6. The flow control assembly of claim 5 wherein said cone shaped tip has a central opening for accepting said drive shaft therein.

7. The flow control assembly of claim 5 wherein said seal protection device has a hollow cylindrical portion adjacent said cone shaped tip for engaging said bearing pack in a fluid sealing manner.

8. The flow control assembly of claim 7 wherein said hollow cylindrical portion is adapted to receive a lubricant for impeding any fluid entering said hollow cylindrical portion from migrating through said bearing pack.

9. The flow control assembly of claim 8 wherein a barrier seal is slidably located within said hollow cylindrical portion intermediate said lubricant and said cone shaped tip to further impede any fluid penetrating said cone shaped tip from migrating to said bearing pack.

10. A pump drive arrangement for an oil well having production tubing extending through a well bore, said pump drive arrangement comprising:

a subsurface rotary pump movably located in the well bore for pumping fluid through the well bore;

a hydraulic drive motor having first and second opposed ends, said first end being located adjacent the subsurface rotary pump and operatively connected thereto to drive said subsurface rotary pump;

hydraulic fluid supply and return lines passing through the well bore and coupled to said second end of the hydraulic drive motor for operating the hydraulic drive motor;

a containment collar for supporting the hydraulic drive motor within the production tubing, said containment collar having a passageway therethrough for channeling fluid from said subsurface rotary pump past said hydraulic drive motor.

11. The pump drive arrangement of claim 10 wherein said containment collar is secured adjacent said first end of the hydraulic drive motor.

12. The pump drive arrangement of claim 11 wherein said containment collar comprises an inner collar portion for securing to said first end of the hydraulic drive motor, an outer collar portion radially spaced from said inner collar portion to form said passageway therebetween, and a means for securing said outer collar portion relative to said inner collar portion.

13. The pump drive arrangement of claim 12 further comprising a seal protection assembly mounted adjacent said first end of the hydraulic drive motor, said seal protection assembly having a cone shaped tip for deflecting fluid traveling from said subsurface rotary pump to said hydraulic drive motor.

14. The pump drive arrangement of claim 13 wherein said seal protection assembly has a hollow cylindrical portion intermediate said cone shaped tip and said hydraulic drive motor for receiving a lubricant therein to impede any fluid entering said hollow cylindrical portion from migrating through said seal protection assembly toward said hydraulic drive motor.

15. The pump drive arrangement of claim 14 wherein a barrier seal is slidably located within said hollow cylindrical portion intermediate said lubricant and said cone shaped tip to further impede any fluid penetrating said cone shaped tip from migrating through said hollow intermediate portion.

* * * * *